US009058009B2

(12) United States Patent
Kobayashi

(10) Patent No.: US 9,058,009 B2
(45) Date of Patent: Jun. 16, 2015

(54) METHOD OF DESIGNING DRIVE UNIT

(71) Applicant: KYOCERA Document Solutions Inc., Osaka (JP)

(72) Inventor: Tatsuya Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/495,320

(22) Filed: Sep. 24, 2014

(65) Prior Publication Data

US 2015/0090060 A1 Apr. 2, 2015

(30) Foreign Application Priority Data

Sep. 30, 2013 (JP) ..... 2013-204788

(51) Int. Cl.
*G03G 15/00* (2006.01)

(52) U.S. Cl.
CPC ..... *G03G 15/757* (2013.01)

(58) Field of Classification Search
CPC ..... G03G 15/757
USPC ..... 399/167
See application file for complete search history.

(56) References Cited

U.S. PATENT DOCUMENTS

| | | | | |
|---|---|---|---|---|
| 5,809,380 | A * | 9/1998 | Katakabe et al. | 399/227 |
| 5,825,472 | A * | 10/1998 | Araki et al. | 399/111 |
| 5,927,148 | A * | 7/1999 | Yamanaka et al. | 74/412 R |
| 6,097,909 | A * | 8/2000 | Watanabe et al. | 399/111 |
| 2002/0018666 | A1 * | 2/2002 | Noda et al. | 399/90 |

FOREIGN PATENT DOCUMENTS

JP 2007-71335 A 3/2007

* cited by examiner

*Primary Examiner* — Rodney Fuller
(74) *Attorney, Agent, or Firm* — Stein IP, LLC

(57) ABSTRACT

A design method of a drive unit includes: deriving a minimum reference contact pressure Fa causing any of the shaft portion among the plurality of the shaft portions to result in damage; and designing the shaft portions or the gears to be of form such that the plurality of shaft portions and the plurality of gears satisfy the relationship F/D×L<Fa, given that, with the plurality of shaft portions and the plurality of gears linked to the drive source and the rotated components, the load acting on a single of the shaft portions among the plurality of shaft portions is F (N), the diameter of the single of the shaft portions is D (mm), and the length of axial contact between the single of the shaft portions and the gear mounted thereon is L (mm).

7 Claims, 10 Drawing Sheets

METHOD OF DESIGNING DRIVE UNIT

CROSS-REFERENCE TO RELATED APPLICATION

This application is based upon, and claims the benefit of priority from, corresponding Japanese Patent Application No. 2013-204788, filed in the Japan Patent Office on Sep. 30, 2013, the entire contents of which are incorporated herein by reference.

BACKGROUND OF THE INVENTION

Unless otherwise indicated herein, the description in this section is not prior art to the claims in this application and is not admitted to be prior art by inclusion in this section.

An image forming apparatus such as a copier, a printer, and a facsimile, generally, includes a chassis structure that is formed by a frame structure made of sheet metal and includes a side plate frame. In the internal space of the chassis structure, a plurality of process units for performing an image formation process is arranged. The process units include, for example, a drum unit, which includes a photoreceptor drum configured to form a toner image and a developer unit, which supplies toner to the photoreceptor drum to form the toner image on the photoreceptor drum. A drive unit or a similar unit, which transmits driving power to rotated components (the photoreceptor drum or the developing roller or similar rotated components) included in the process units, is assembled to the side plate frame. This type of drive unit includes an array of a plurality of drive gears and a resin chassis that covers the array.

The resin chassis includes two plate-formed materials, and rotation shafts that each pivotally support the drive gears are arranged between the plate-formed materials. When the drive gear is rotated, a predetermined driving load is acting on the rotation shaft. There is provided a technique that causes a bearing to rotate in a predetermined timing not to concentrate loads in the same position of the bearing, which rotatably supports the rotation shaft.

SUMMARY OF THE INVENTION

A design method of a drive unit according to one aspect of the disclosure designs the drive unit that includes a sheet metal frame, a housing, and a plurality of gears. The sheet metal frame has a plurality of bearing holes. The housing is mounted on the sheet metal frame. The housing is made of a predetermined resin material. The housing is provided with a plurality of shaft portions projecting toward the sheet metal frame. Each of the plurality of shaft portions have a distal-end portion pivotally supported in the bearing holes. The plurality of gears are rotatably mounted respectively on the plurality of shaft portions. The drive unit is linked to a preestablished drive source and transmits, via a drive transmission path constituted by the plurality of the gears, rotational driving power of the drive source to rotated components each having a predetermined load torque. The design method includes: deriving a minimum reference contact pressure Fa being a contact pressure acting on the plurality of shaft portions made of the resin material, and being the minimum contact pressure that leads to damage in any shaft portion among the plurality of the shaft portions; and designing the shaft portions or the gears to be of form such that the plurality of shaft portions and the plurality of gears satisfy the relationship $F/D \times L < Fa$, given that, with the plurality of shaft portions and the plurality of gears linked to the drive source and the rotated components, the load acting on a single of the shaft portions among the plurality of shaft portions is F (N), the diameter of the single of the shaft portions is D (mm), and the length of axial contact between the single of the shaft portions and the gear mounted thereon is L (mm).

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
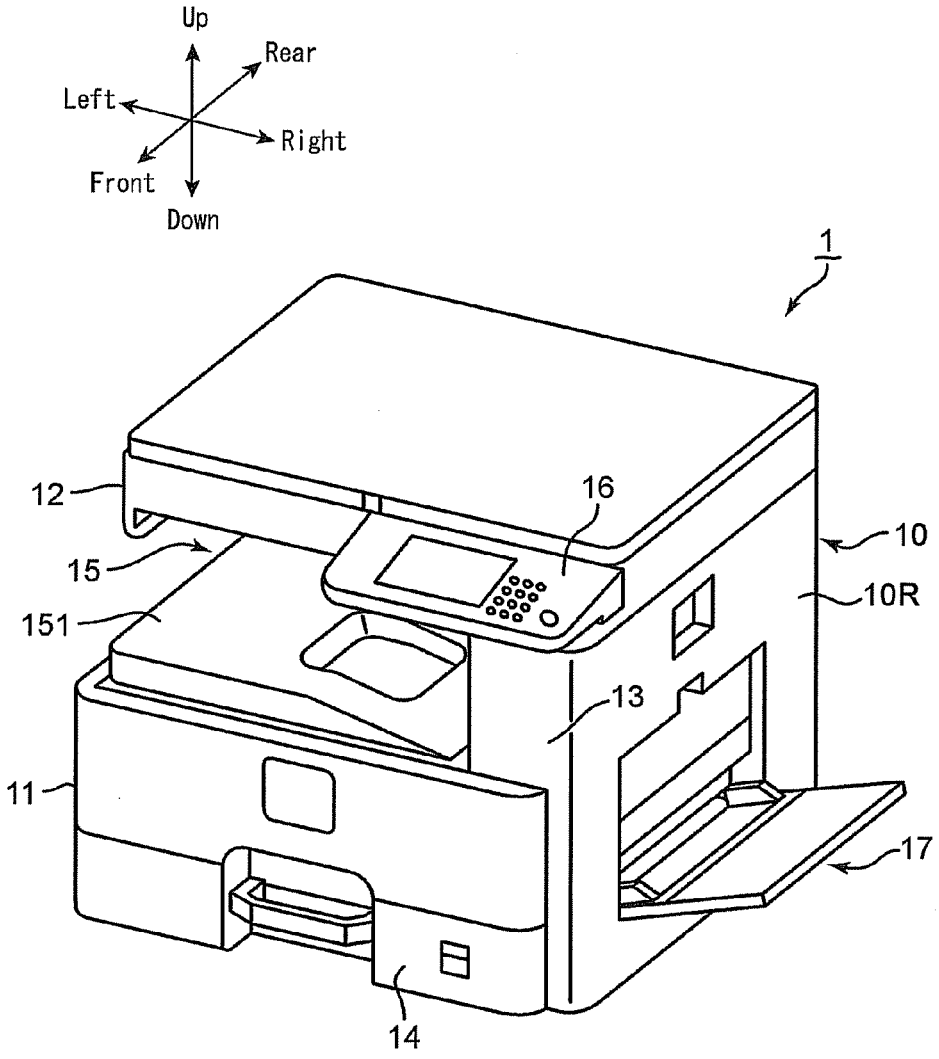
FIG. 1 diagonally illustrates an external appearance of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Hereinafter, a description will be given of embodiments of the disclosure with reference to the drawings. FIG. 1 diagonally illustrates an external appearance of an image forming apparatus 1 according to the embodiment of the disclosure. The image forming apparatus 1 is a black and white color printer having a copy function and includes a main body chassis 10 in a box form. The main body chassis 10 includes a lower chassis 11, an upper chassis 12 arranged on the upper side of the lower chassis 11, and a connection chassis 13, which is located between the lower chassis 11 and the upper chassis 12 and arranged at a right-side surface 10R side of the main body chassis 10.

The lower chassis 11 houses various units to perform an image formation process to a sheet. The upper chassis 12 is used when the image forming apparatus 1 functions as a copier and houses a scanner device, which optically reads images in the sheet of an original document. A sheet cassette 14, which retains a bundle of the sheets where the image formation process is performed, is removably mounted in a front face of the lower chassis 11. The main body chassis 10 includes an in-body paper discharge space 15 where the sheet, after the image formation process is performed, is discharged. The in-body paper discharge space 15 is a space partitioned by the top surface of the lower chassis 11, the lower surface of the upper chassis 12, and a left side surface of the connection chassis 13. An in-body sheet discharge tray 151, which receives the sheets, is located in a bottom portion of the in-body paper discharge space 15. An operation panel 16, which accepts input of operation information of a user to the image forming apparatus 1, is mounted in the front face of the upper chassis 12. Further, in the right-side surface 10R of the main body chassis 10, a bypass tray 17 for paper-feeding of the sheet by hand is located openably/closably with respect to the right-side surface 10R.

Figure 2:
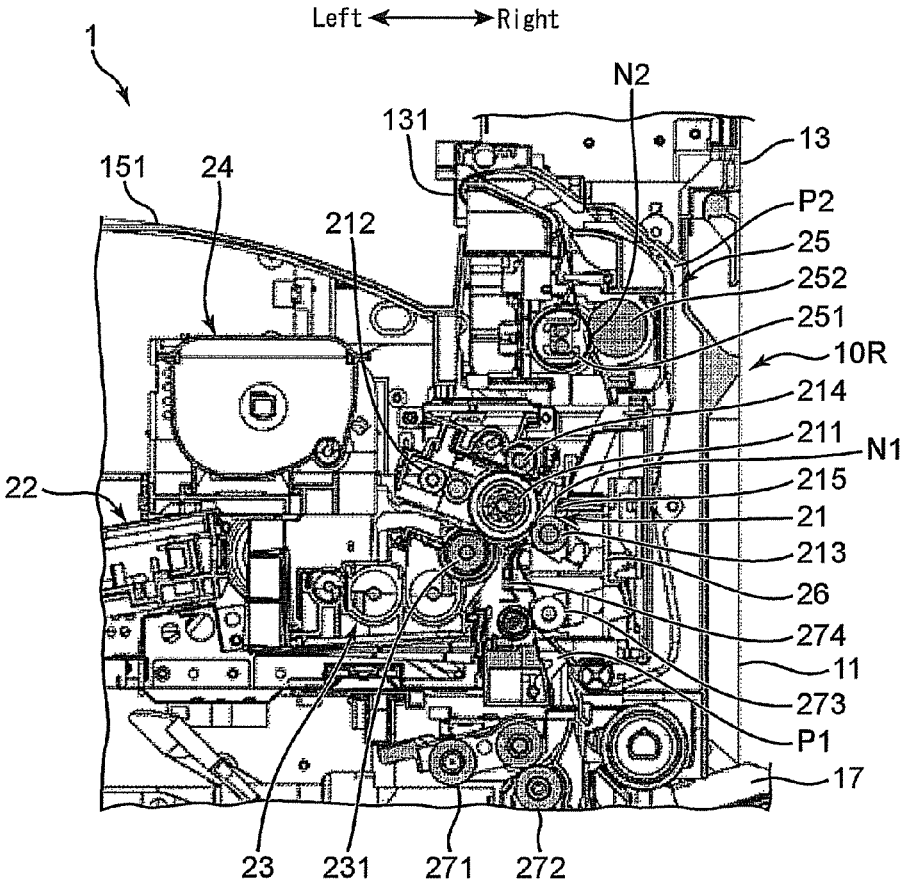
FIG. 2 illustrates a main part of an internal structure of the image forming apparatus according to the one embodiment.

FIG. 2 illustrates a main part of an internal structure of the image forming apparatus 1. In FIG. 2, across-sectional view in a lateral direction of both a right-half upward portion of the lower chassis 11 and the connection chassis 13 is illustrated. Within the lower chassis 11, as the units for image formation, a drum unit 21, an exposure unit 22, a developer unit 23, a toner container 24, a fixing unit 25, and a conveying unit 26, and a similar unit are housed. These can be removed from the lower chassis 11 (a frame structure 30 described below) on a unit-by-unit basis.

The drum unit 21 is the unit that includes a photoreceptor drum 211, a charging apparatus 212 and a cleaning apparatus 214, which are arranged in a peripheral area of the photoreceptor drum 211. The developer unit 23 is the unit that includes a developing roller 231 in contact with the photoreceptor drum 211. In the conveying unit 26, a transfer roller 213 in contact with the photoreceptor drum 211 is mounted.

The photoreceptor drum 211 rotates around its axis and includes a circumference surface where an electrostatic latent image and a toner image are formed. The charging apparatus 212 uniformly electrostatic charges the circumference surface of the photoreceptor drum 211. The exposure unit 22 irradiates the circumference surface of the photoreceptor drum 211 with a laser beam to form the electrostatic latent images. The developing roller 231 of the developer unit 23 supplies toner onto the circumference surface of the photoreceptor drum 211 to develop the electrostatic latent image formed on the circumference surface of the photoreceptor drum 211. The transfer roller 213 forms a transfer nip portion N1 with the photoreceptor drum 211 and transfers the toner image of the photoreceptor drum 211 to the sheet. The cleaning apparatus 214 cleans the circumference surface of the photoreceptor drum 211 after the transfer of the toner image. The toner container 24 replenishes the toner to the developer unit 23.

The fixing unit 25 includes a fixing roller 251 with a built-in heat source and a pressure roller 252, which forms a fixing nip portion N2 together with the fixing roller 251. The fixing unit 25 performs a fixing process by heating and pressuring the sheet, where the toner images are transferred at the transfer nip portion N1, at the fixing nip portion N2. The sheet where the fixing process was performed is discharged from a sheet discharge port 131 toward the in-body sheet discharge tray 151.

In the main body chassis 10, a sheet conveyance path for conveying the sheet is provided. In the sheet conveyance path, a main conveyance path P1, which vertically extends from near a lower part of the lower chassis 11 to the connection chassis 13 via the transfer nip portion N1 and the fixing nip portion N2 and reaches the sheet discharge port 131, is included. Furthermore, an inverting conveyance path P2, which performs inverting conveyance of the sheet during duplex printing, is located extending from the most downstream end to near the up stream end of the main conveyance path P1.

The sheet cassette 14 includes a sheet chassis portion chassis a sheet bundle. Near the upper right of the sheet chassis portion, a pickup roller 271, which feeds the sheet in the uppermost layer of the sheet bundle one by one and a feed roller pair 272, which sends out the sheet to the upper stream end of the main conveyance path P1, are provided. In the upstream side with respect to the transfer nip portion N1 of the main conveyance path P1, a registration roller pair 273, which sends out the sheet to the transfer nip portion N1 at a predetermined timing, is arranged.

The main conveyance path P1 and the inverting conveyance path P2 are formed using an internal surface (a left side surface) and an outer surface (a right-side surface) of the conveying unit 26. For example, the main conveyance path P1 in an immediate upper stream of the transfer nip portion N1 is partitioned by the internal surface of the conveying unit 26 and a pre-transfer guide 274 arranged facing the internal surface of the conveying unit 26. In the conveying unit 26, the transfer roller 213 is mounted as described above, and furthermore, one of the rollers of the registration roller pair 273 and one of the rollers of a conveyance roller pair (not illustrated), which conveys the sheet in the inverting conveyance path P2, are mounted.

A description will be briefly given about an image forming operation of the image forming apparatus 1. First, the circumference surface of the photoreceptor drum 211 is approximately uniformly electrostatic charged by the charging apparatus 212. The circumference surface of the photoreceptor drum 211 electrostatic charged is exposed by the laser beam emitted from the exposure unit 22. This forms the electrostatic latent image of the image, which is to be formed on the sheet, on the circumference surface of the photoreceptor drum 211. The electrostatic latent image is visualized as the toner images due to a supply of the toner on the circumference surface of the photoreceptor drum 211 from the developer unit 23.

When the single-side printing process is conducted to the sheet, the sheet is sent out from the sheet cassette 14 or the bypass tray 17 to the main conveyance path P1. A transfer process of the toner images is performed to the sheet at the transfer nip portion N1, and then the fixing process, which causes the transferred toner to fix onto the sheet, is performed at the fixing nip portion N2. Then, the sheet is ejected onto the in-body sheet discharge tray 151 from the sheet discharge port 131. On the other hand, when the duplex printing process is performed on a sheet, after the transfer process and the fixing process are performed to one surface of the sheet, a part of the sheet is ejected onto the in-body sheet discharge tray 151 from the sheet discharge port 131. Then, the sheet is reversely conveyed and is returned near the upper stream end of the main conveyance path P1 via the inverting conveyance path P2. Thereafter, the transfer process and the fixing process are performed to another surface of the sheet, and the sheet is ejected onto the in-body sheet discharge tray 151 from the sheet discharge port 131.

Figure 3:
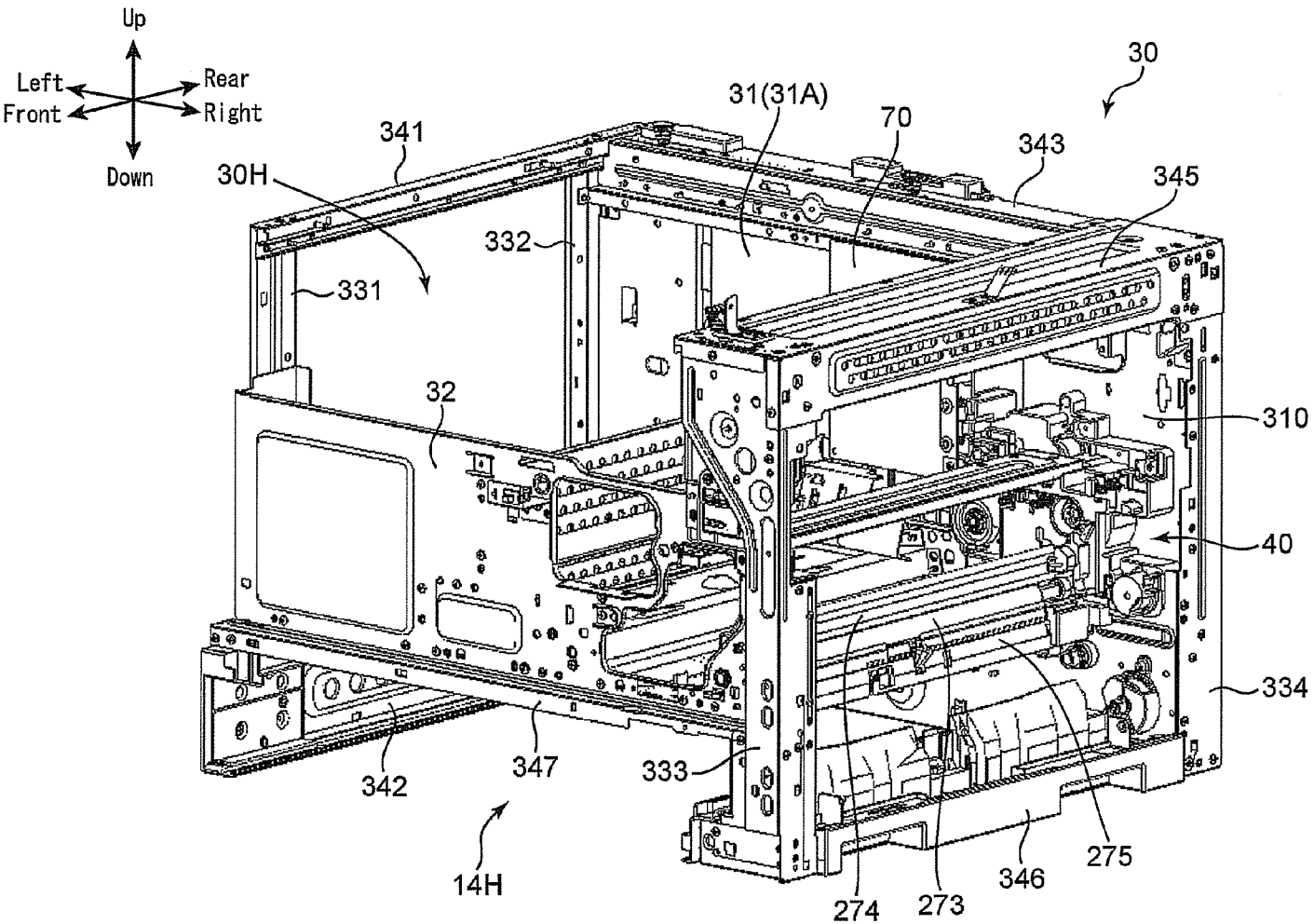
FIG. 3 illustrates a frame structure according to the one embodiment viewed from the front upper right.
Figure 4:
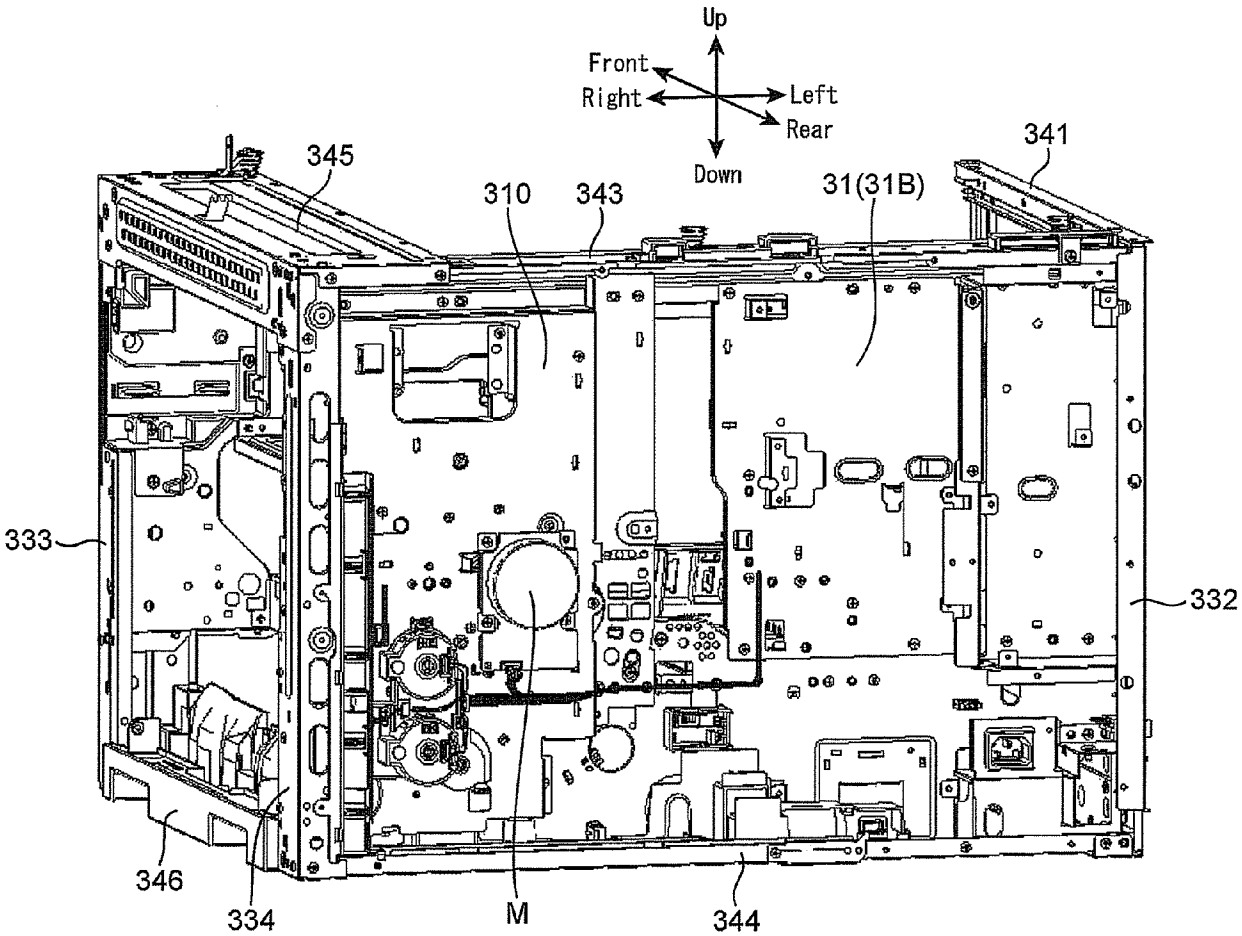
FIG. 4 illustrates the frame structure according to the one embodiment viewed from the rear upper right.

Subsequently, a description will be given of the frame structure 30 according to the embodiment. FIG. 3 illustrates the frame structure 30 viewed from the front upper right, and FIG. 4 illustrates the frame structure 30 viewed from the rear upper right. The frame structure 30 is to be incorporated in the lower chassis 11. The frame structure 30 is a frame structure that forms a chassis structure having an internal space 30H, which houses the above-described drum unit 21, the exposure unit 22, the developer unit 23, the toner container 24, the fixing unit 25, and the conveying unit 26.

The frame structure 30 is formed from members made of sheet metal. The frame structure 30 includes: a rear side plate frame 31; a front side plate frame 32; a first, a second, a third, a fourth bar-formed vertical frames 331, 332, 333, and 334; and a first, a second, a third, a fourth, a fifth, a sixth, a seventh bar-formed horizontal frames 341, 342, 343, 344, 345, 346, and 347.

The first and the second vertical frames 331 and 332 are disposed upright in parallel at intervals in the front-back direction. The upper ends and the lower ends of the first and second vertical frames 331 and 332 are linked by the respective first and second horizontal frames 341 and 342 extending in the front-back direction. A square-frame-formed frame assembly formed of these four of the bar-formed frames 331, 332, 341, and 342 constitutes a left sidewall of the frame structure 30. The third and the fourth vertical frames 333 and 334 are disposed upright in parallel at intervals in the front-back direction. The upper ends and the lower ends of the third and fourth vertical frames 333 and 334 are linked by the respective fifth and sixth horizontal frames 345 and 346 extending in the front-back direction. A square-frame-formed frame assembly formed of these four of the bar-formed frames 333, 334, 345, and 346 constitutes a right sidewall of the frame structure 30.

The second and the fourth vertical frames 332 and 334, which are rear side vertical frames, hold respective left edge and right edge of the rear side plate frame 31. In addition, the upper ends and the lower ends of the second and the fourth vertical frames 332 and 334 are linked by the respective third and fourth horizontal frames 343 and 344 extending in the lateral direction. The third and the fourth horizontal frames 343 and 344 each hold the upper end edge and the lower end edge of the rear side plate frame 31. That is, the square-frame-formed frame assembly is formed of these bar-formed frames 332, 334, 343, and 344, and its opening is approximately covered by the rear side plate frame 31. Further, in practice, the rear side plate frame 31 is split into some of side plate pieces. For example, a right side portion of the rear side plate frame 31 is constituted of a vertically elongated side plate frame piece 310 (a sheet metal frame) made of the sheet metal (see FIG. 4 and FIG. 5).

The first and the third vertical frames 331 and 333, which are the front side vertical frames, hold the respective left end edge and right end edge of the front side plate frame 32. The front side plate frame 32 is a side plate frame having a vertical width, which is degree of half of the height of the first and the third vertical frames 331 and 333. The lower edge portion of the front side plate frame 32 is located in the higher position than the bottom portion, and the lower edge portion is supported by the seventh horizontal frame 347, which extends in the lateral direction. Agate type opening 14H, which is partitioned by the lower end portions of the first and the third vertical frames 331 and 333 and the seventh horizontal frame 347, is an opening where the sheet cassette 14 is mounted.

While in FIG. 3 the frame structure 30 is illustrated in the state where various units are not mounted in the internal space 30H, the state where the above-described pre-transfer guide 274 and a conveyance guide member 275, which holds one of the rollers of the registration roller pair 273 are mounted is illustrated. The rear side plate frame 31 has an internal surface 31A, which faces the internal space 30H, and an outer surface 31B, which is an opposite side of the internal surface 31A. The outer surface 31B is a surface that faces an inner surface of an exterior member of the lower chassis 11. In the internal surface 31A of the rear side plate frame 31, a drive unit 4 (see FIG. 5) is arranged. On the other hand, in the outer surface 31B of the rear side plate frame 31, a driving motor M (see FIG. 4) (a driving source), which provides a rotational driving power to a drive gear group 50 described below, is mounted.

Figure 5:
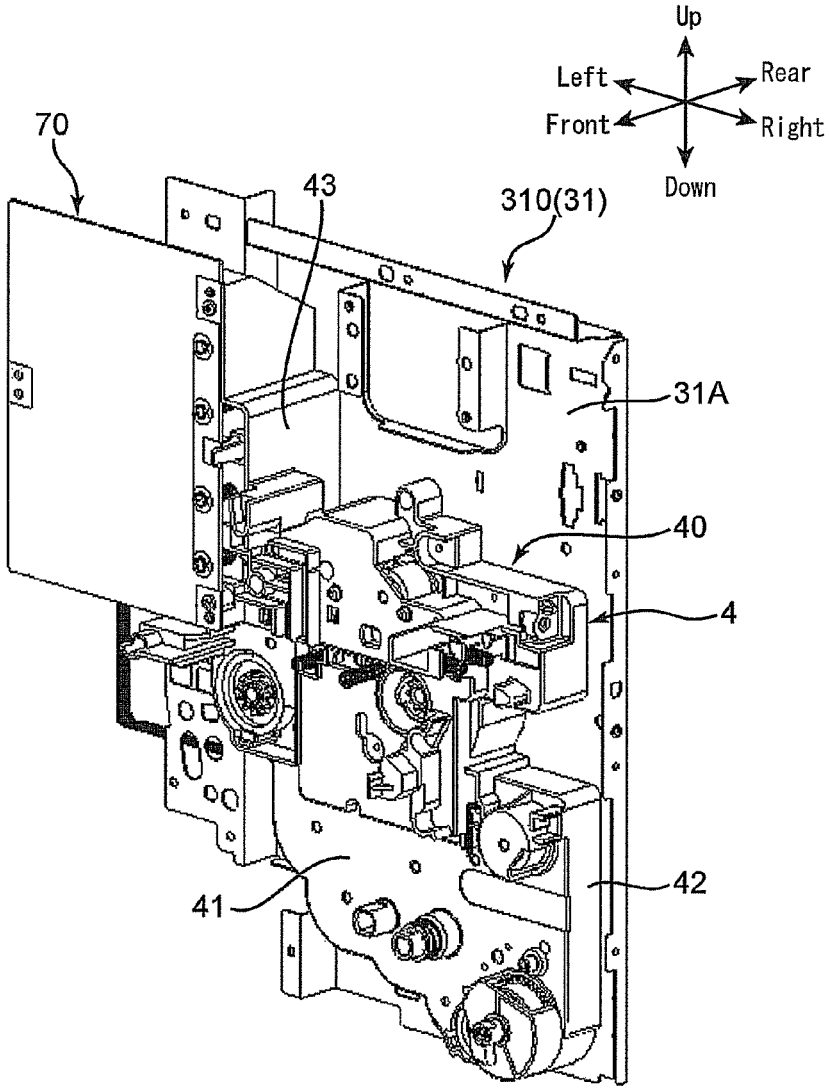
FIG. 5 diagonally illustrates a chassis of a drive unit to which a high voltage substrate according to the one embodiment is mounted and a part of a sheet metal frame.
Figure 6:
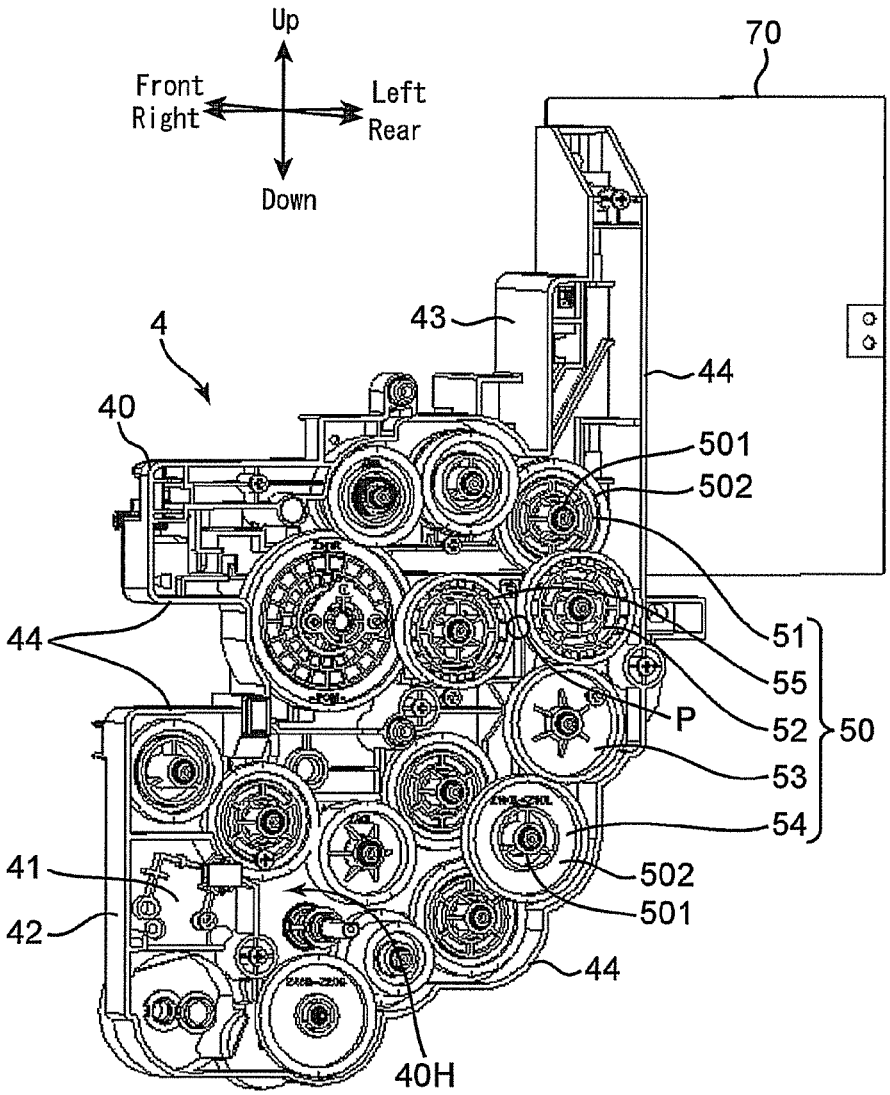
FIG. 6 illustrates the chassis of the drive unit according to the one embodiment viewed from an opening side.
Figure 7:
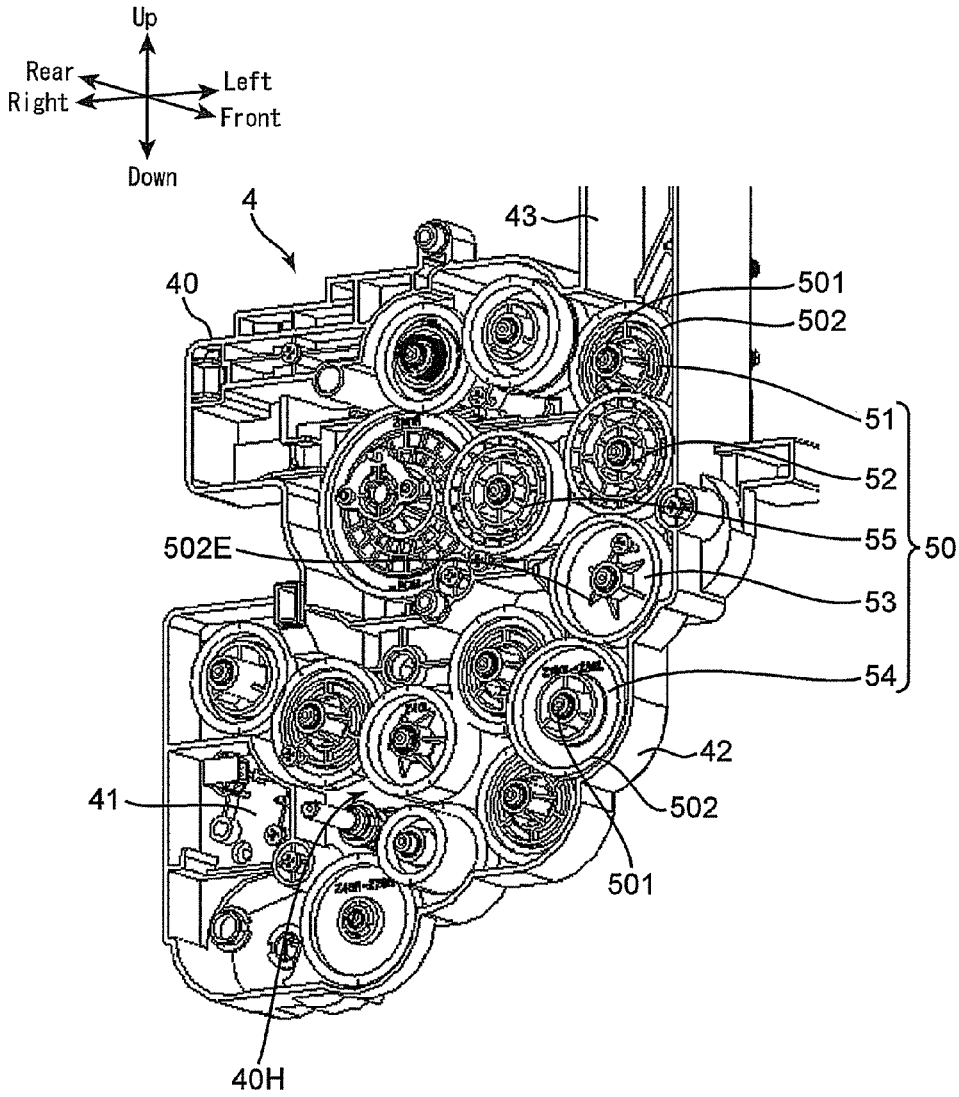
FIG. 7 illustrates the chassis of the drive unit according to the one embodiment viewed from the opening side.
Figure 8:
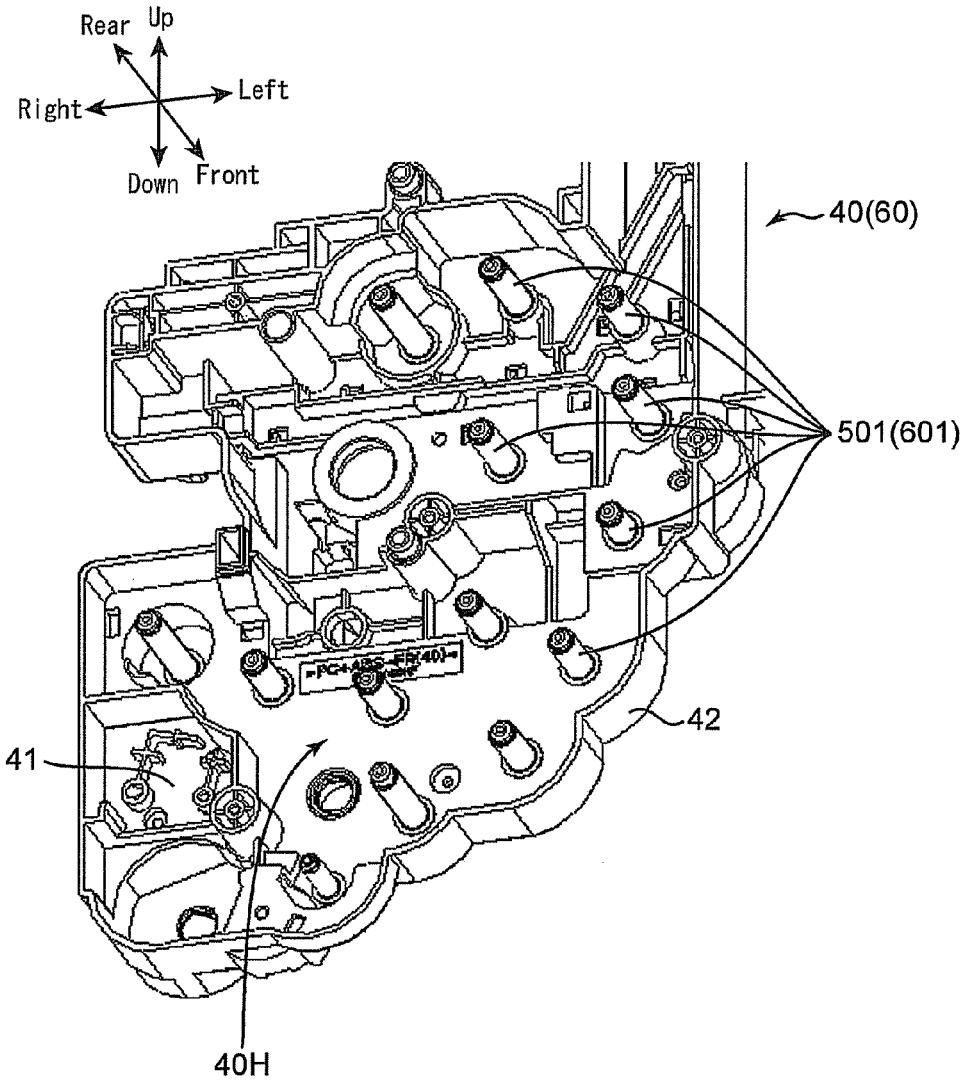
FIG. 8 illustrates a state where a plurality of gears are removed from the chassis of the drive unit according to the one embodiment viewed from a side of a sheet metal frame.
Figure 9:
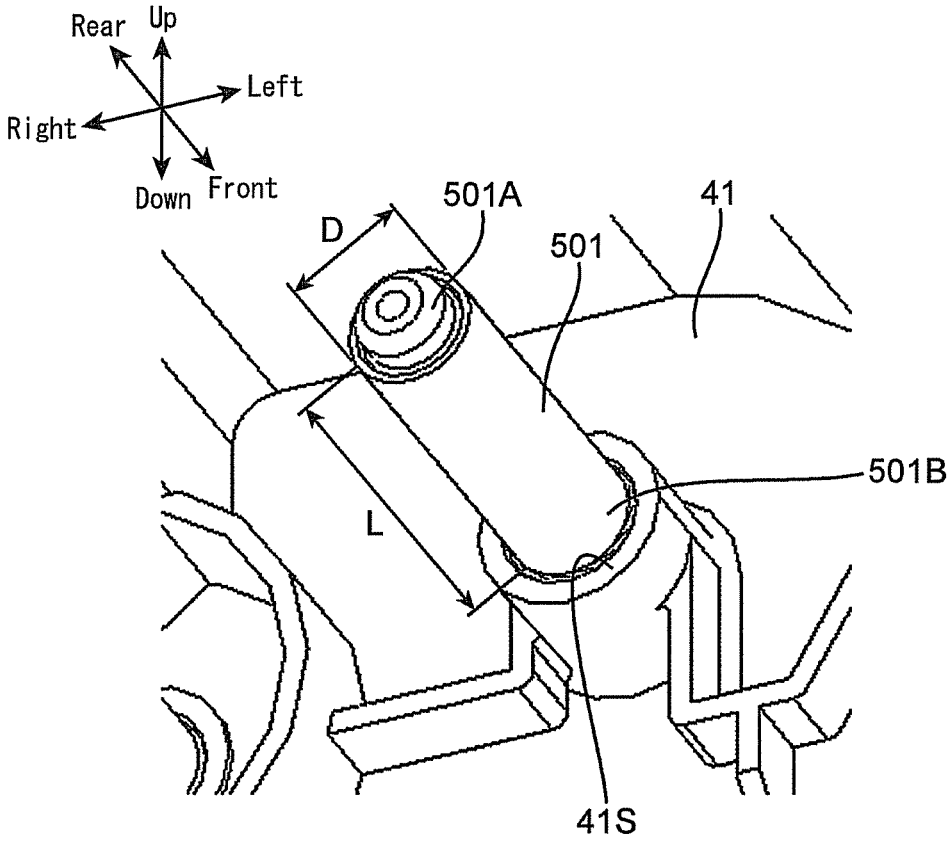
FIG. 9 illustrates an enlarged one of shaft portions of the chassis of the drive unit according to the one embodiment.
Figure 10:
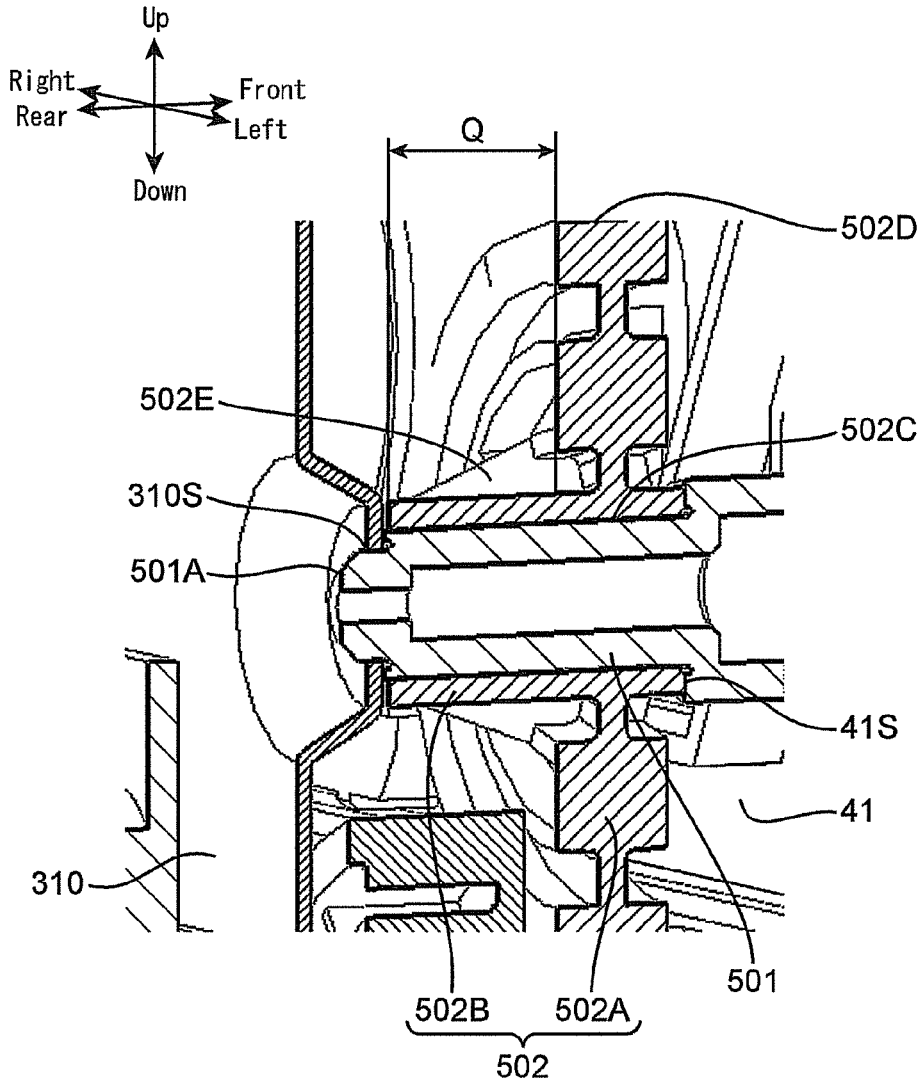
FIG. 10 illustrates an appearance where the gear is pivotally supported in the shaft portion between the sheet metal frame and the chassis according to the one embodiment.

The following describes the constitution of the drive unit 4 and the constitution relating to this in detail. FIG. 5 illustrates a drive chassis 40 where a high voltage substrate 70 is mounted and the side plate frame piece 310. FIG. 6 and FIG. 7 illustrate the drive chassis 40, where the drive gear group 50 is mounted, viewed from a side of an opening. In addition, FIG. 8 illustrates a state where the drive gear group 50 (a plurality of gears) is removed from the drive chassis 40 viewed from a side of the side plate frame piece 310. Further, FIG. 9 illustrates one enlarged rotation shaft 501 in the drive chassis 40 of the drive unit 4. FIG. 10 illustrates an appearance where a rotation gear 502 is pivotally supported onto the rotation shaft 501 between the side plate frame piece 310 and the drive chassis 40.

The drive unit 4 is linked to the driving motor M. The drive unit 4 transmits the rotational driving power of the driving motor M to the photoreceptor drum 211 and the developing roller 231 (a rotated component) via a drive transmission path built by the drive gear group 50. In addition, the photoreceptor drum 211 and the developing roller 231 each have a predetermined load torque. The drive unit 4 includes the drive chassis 40 (a housing), the drive gear group 50, and the side plate frame piece 310.

The drive chassis 40 is a member made of resin, which is molded using a hard resin material with an electrical insulation property. Specifically, the drive chassis 40 is constituted of the hard resin material of ABS resins where polycarbonate is contained. The drive chassis 40 is mounted onto the side plate frame piece 310.

The drive chassis 40 (see FIG. 5) includes a bottom plate 41 having mostly a flat plate and a side plate 42 disposed upright from a peripheral edge of the bottom plate 41. Further, the drive chassis 40 includes a substrate supporting unit 43 supporting the high voltage substrate 70 in an upper left portion. That is, the drive chassis 40 also serves as the member to support the high voltage substrate 70. The substrate supporting unit 43 is a portion where the bottom plate 41 and the side plate 42 are located extending in a manner to project to the upper left. Furthermore, use of the drive chassis 40 positions and fixes the rear end portions of the pre-transfer guide 274 and the conveyance guide member 275.

An upright end edge of the side plate 42 is an opening edge 44 of the drive chassis 40. That is, the drive chassis 40 is a bottomed container that has an opening surface, which faces the bottom plate 41, and has a cavity 40H (see FIG. 6) corresponding to an upright height of the side plate 42. The cavity 40H is a space for accommodating the drive gear group 50. The drive chassis 40 is mounted with respect to the rear side plate frame 31 (the side plate frame piece 310) such that the opening is sealed by the internal surface 31A of the rear side plate frame 31 (the side plate frame piece 310), specifically, the opening edge 44 is brought into contact with the internal surface 31A.

With reference to FIG. 7 and FIG. 8, the drive chassis 40 includes a plurality of the rotation shafts 501 (shaft portions). The rotation shaft 501 is disposed projecting toward the side plate frame piece 310. With reference to FIG. 9, the rotation shaft 501 includes a distal end portion 501A and a base end portion 501B. The distal end portion 501A is designed to be slightly small in diameter compared with the main body portion of the rotation shaft 501. The distal end portions 501A (see FIG. 9) are pivotally supported with the respective plurality of bearing holes 310S (see FIG. 10) opened in the side plate frame piece 310. As illustrated in FIG. 9, the base end portion 501B of the rotation shaft 501 is supported with a protrusion supporting portion 41S in the bottom plate 41, and a side of the distal end portion 501A of the rotation shaft 501 is disposed upright in the vertical direction with respect to the bottom plate 41. That is, the side of the distal end portion 501A of the rotation shaft 501 is an opening surface of the drive chassis 40. In this embodiment, the plurality of the rotation shafts 501, as a part of the drive chassis 40, are formed by integral molding of the resin material.

The drive gear group 50 (see FIG. 6 and FIG. 7) is constituted by an array of a plurality of drive gears 51, 52, 53, 54, 55, and so on (gears), which serve as reduction gears. Idler gears or similar gears. The drive gear group 50 transmits the rotational driving power of the driving motor M to the rotating members (rotated components such as the photoreceptor drum 211 and the developing roller 231) included in the drum unit 21, the developer unit 23, and a similar unit. The side plate 42 has a form that approximately densely surrounds the peripheral area of the drive gear group 50. However, the substrate supporting unit 43 is not a portion which follows the peripheral form of the drive gear group 50, and the drive gear is not housed in the substrate supporting unit 43

With reference to FIG. 7 and FIG. 8, the drive gear group 50 is rotatably mounted onto the rotation shaft 501 described above. Further, with reference to FIG. 10, the drive gears 51, 52, 53, 54, 55, and so on each include the rotation gear 502. The rotation gear 502 includes a gear main portion 502A and a boss portion 502B. The gear main portion 502A is the main body portion of the rotation gear 502, which is disc-formed. The gear main portion 502A includes an inner peripheral portion 502C and an outer periphery portion 502D. The inner peripheral portion 502C is an inner peripheral portion of the gear main portion 502A and pivotally supported by the rotation shaft 501. The outer periphery portion 502D is an outer periphery portion of the gear main portion 502A and includes gear teeth (not illustrated) on a circumference surface. The boss portion 502B is disposed axially projecting from the gear main portion 502A. The boss portion 502B is a cylindrical portion installed sequentially with the inner peripheral portion 502C and is pivotally supported by the rotation shaft 501 together with the gear main portion 502A. An arrangement of the boss portion 502B increases a contacted area between the rotation shaft 501 and the rotation gear 502. As a result, it is prevented that a load acting on the rotation shaft 501 from the rotation gear 502 concentrates on one part of the circumference surface of the rotation shaft 501. Furthermore, among the drive gear group 50, the gears provided with the gear main portion 502A alone and do not include the boss portion 502B are also contained.

In addition, the above-described output shaft of the driving motor M is meshed with the drive gears 51 and 55. In FIG. 6, the circle portion illustrated with a sign P is a meshing position of the output shaft of the driving motor M. Since the driving motor M is mounted on the outer surface 31B of the rear side plate frame 31 made of sheet metal, use of the rear side plate frame 31 can cause a heat emitted by the driving motor M to dissipate. In addition, linking the other gears among the drive gear group 50 to the photoreceptor drum 211 and the developing roller 231 transmits the rotational driving power of the driving motor M to the photoreceptor drum 211 and the developing roller 231 via the drive gear group 50.

The side plate frame piece 310 is a part of the rear side plate frame 31. As described above, the side plate frame piece 310 includes a plurality of the bearing holes 310S (see FIG. 10). Furthermore, while the bearing hole 310S does not appear in FIG. 4, the plurality of the bearing holes 310S are opening in the side plate frame piece 310, facing the plurality of the rotation shafts 501 of the drive chassis 40. The bearing holes 310S each pivotally support the distal end portion 501A of the rotation shaft 501.

Thus, in this embodiment, the drive unit 4 is ensured to be sandwiched between the drive chassis 40 made of resin material and the metallic side plate frame piece 310. Further, the rotation shaft 501, which rotatably pivotally supports each gear of the drive gear group 50, is a part of the drive chassis 40 and is constituted from the resin material. In view of this, compared with the case where a plurality of the rotation shafts are provided with another member separately from the drive chassis 40, the rotation shafts are not necessary to be fit into the drive chassis 40. Additionally, compared with the case where metal pins, which are expensive compared with resin material, are used as the rotation shafts, the rotation shaft are constituted in a low-price. As a result, a reduction of the number of components and cost for the drive unit 4 is achieved.

Furthermore, according to the constitution of the embodiment, the opening surface of the drive chassis 40 accommodating the drive gear group 50 is obstructed by the rear side plate frame 31. Therefore, while reducing the number of components of the drive chassis 40 by locating the openings, the construction to reduce the noise from operating sounds of gears can be ensured by sandwiching the drive gear group 50 between the bottom plate 41 and the internal surface 31A of the rear side plate frame 31. Additionally, since the high voltage substrate 70 is supported in the substrate supporting unit 43 of the drive chassis 40, it is not necessary to prepare separately installation positions and mounting components (terminal blocks or similar components) for the high voltage substrate 70 with respect to the rear side plate frame 31. Thus ensures the reduction of the number of components and easy securing of installation positions.

Design Method of Drive Unit 4

Next, the design method of the drive unit 4 including the construction as described above will be described in detail. As described above, in the drive unit 4 according to the embodiment, the drive gear group 50 is pivotally supported with the rotation shaft 501 integrated with the drive chassis 40. In this case, while the cost reduction of the drive unit 4 is ensured, replacement of the entire drive chassis 40 becomes necessary when any of the rotation shafts 501 pivotally supporting the drive gear group 50 is damaged. In view of this, the rotation shaft 501 requires high durability and reliability. In addition, while the cost increases when the rotation shaft 501 is provided with the metal pin, high durability is obtained due to the strength of metal.

The inventor of the disclosure performed analyses in detail on a damage mechanisms of the rotation shaft 501 disposed projecting from the drive chassis 40 in the structure where the drive unit 4 is sandwiched by the side plate frame piece 310 and the drive chassis 40 made of resin. As a result, it was found that the damage of the rotation shaft 501 depends on a contact pressure acting on the rotation shaft 501. In other words, assuming that the form of the rotation shaft 501 and the rotation gear 502 are designed corresponding to the strength of the resin material used for the rotation shaft 501 without considering the contact pressure acting on the rotation shaft 501. In this case, along with sudden damages brought to the rotation shaft 501, the resin material used for the drive chassis 40 will excessively be elevated, and the drive unit 4 will result in cost increase.

In this embodiment, the design method for the drive unit 4 includes the following a first step and a second step described below. The first step is a process for deriving the minimum reference contact pressure Fa. Further, the second step is a process for designing the forms of the rotation shaft 501 and the rotation gear 502 based on the derived minimum reference contact pressure Fa.

First Step

The first step derives the minimum reference contact pressure Fa where any of the rotation shaft 501 among the plurality of the rotation shafts 501 results in the damage. The minimum reference contact pressure Fa is a contact pressure acting on the plurality of rotation shafts 501 made of resin material. The minimum reference contact pressure Fa varies by the resin material used.

For more details, at the first step, a predetermined reference contact pressure derivation test (a verification test) is performed. In this test, in the reference contact pressure derivation test, a test chassis 60 (see FIG. 8) and a test drive gear group (an unillustrated test gear) are used. The test chassis 60 includes a plurality of test rotation shafts 601 (test shaft portions), which are disposed projecting toward the side plate frame piece 310 and include distal end portions each pivotally supported by the bearing hole 310S. The test chassis 60 is constituted of the same resin material as a material of the drive chassis 40. In addition, FIG. 8 illustrates the test chassis 60 written in the parenthesis with respect to the drive chassis 40. In practice, while the test chassis 60 and the drive chassis 40 finally to be designed will be slightly different in form, the forms and structures are approximately similar. In particular, the test rotation shaft 601 and the rotation shaft 501 finally designed will be slightly different in form (in outer diameter and axial direction length). Preliminarily, the test chassis 60 is prepared based on functions required for the drive unit 4. Furthermore, the test drive gear group is, in the same manner as the drive gear group 50, rotatably pivotally supported in the test rotation shaft 601.

Then, in the reference contact pressure derivation test, with the plurality of test drive gear groups mounted onto the test rotation shaft 601 of the test chassis 60, the test chassis 60 is mounted onto the side plate frame piece 310. Further, the driving motor M is linked to one of the gear among the test drive gear group while a test rotated component is linked to the other gears among the test drive gear group. Additionally, the test rotated component is a load mechanism for the test, corresponding to the above-described photoreceptor drum 211, developing roller 231, and fixing unit 25. In this embodiment, the reference contact pressure derivation test is performed in a high temperature environment at 32.5° C. as a peripheral environment, which is a stress condition where the test rotation shaft 601 is damaged easily. For one example of the test, the reference contact pressure derivation test was performed by increasing a load which corresponds to the fixing unit 25 from 1.5 kg·cm in increments of 0.1 kg·cm. Furthermore, the test rotation shaft 601 was set to ϕ8 mm in diameter and the test was performed using two kinds of the test drive gear where axial contact lengths are different with respect to the test rotation shaft 601.

When the reference contact pressure derivation test is started, a load torque that corresponds to the fixing unit 25 is set to the above-described value, and the driving motor M is driven and rotated for 30 minutes. Then, it is confirmed whether or not an abnormality occurs during and after the drive rotation of the driving motor M in the test rotation shaft 601. With the load torque sequentially being elevated, finally, the contact pressure that is acting on the circumference surface of the test rotation shaft 601, when an abnormality such as damage occurs to the test rotation shaft 601, is derived as the minimum reference contact pressure Fa. First, considering transmission efficiency, a gear ratio, and a similar factor of each test drive gear, a torque X (kgf·cm) of the test drive gear mounted on the damaged test rotation shaft 601 is derived from the load torque of the test rotated component when the test rotation shaft 601 is damaged. Then, when a pitch circle diameter of the test drive gear is Dp (mm) and a pressure angle of the test drive gear is α (deg.), a radial direction load Ks (N) against the test rotation shaft 601 of the test drive gear is calculated by the following Formula 1.

$$Ks=19.1\times10^{6}\cdot H/(Dp\cdot n)\times\tan\alpha \quad \text{(Formula 1)}$$

In Formula 1, H is a transmission power (kW) and n is a rotation speed ($min^{-1}$)

In Formula 1, the transmission power H is calculated by the following Formula 2.

$$H[k\cdot W]=(0.0981\times X)\ [N\cdot m]\times(2\pi n/60)\ [rad/s]/1000 \quad \text{(Formula 2)}$$

As a result, Formula 1 is transformed to the following Formula 3.

$$Ks=(196\times X/Dp)\times\tan\alpha \quad \text{(Formula 3)}$$

Then, when the diameter of the test rotation shaft 601 is A (mm) and an axial contact length between the test rotation shaft 601 and the test drive gear is B (mm), the minimum reference contact pressure Fa ($N/mm^2$) is calculated by the following Formula 4.

$$Fa=Ks/(A\times B) \quad \text{(Formula 4)}$$

Second Step

The second step designs the final forms of the rotation shaft 501 of the drive chassis 40 and the rotation gear 502 of the drive gear group 50 based on the derived minimum reference contact pressure Fa. Specifically, assume that with the drive unit 4 linked to the driving motor M and the photoreceptor drum 211 or the developing roller 231, a load acting on one of the rotation shaft 501 among the plurality of the rotation shafts 501 is F (N), a shaft diameter of the one of the rotation shaft 501 is D (mm), and a axial contact length between the one of the rotation shaft 501 and the rotation gear 502 mounted onto the one of the rotation shaft 501 is L (mm). In this case, the form of the rotation shaft 501 or the rotation gear 502 is designed such that a contact pressure Fb acting on the rotation shaft 501 satisfies the relationship: Fb (=F/D×L)<Fa. Specifically, the shaft diameter D of the rotation shaft 501 or the contact length L between the rotation shaft 501 and the rotation gear 502 is designed. Then, the above-described relational expression needs to be satisfied for all the plurality of the rotation shafts 501 and all the plurality of the rotation gears 502.

In this respect, the increased contact length L between the rotation shaft 501 and the rotation gear 502 can reduce the contact pressure Fb acting on the rotation shaft 501. As described above, some of the rotation gears 502 of the drive gear group 50 include the boss portion 502B in addition to the gear main portion 502A. In this case, at the second step, as the form of the rotation gear 502, a projecting length Q, where the boss portion 502B is disposed projecting from the gear main portion 502A, may be set to satisfy the relationship: $F/D \times L < Fa$. With the projecting length Q of the boss portion 502B adjusted, the contact length L is varied and the contact pressure Fb acting on the rotation shaft 501 can be adjusted. Further, arranging a plurality of ribs 502E in the outer peripheral portion of the boss portion 502B can uniformize the contact pressure Fb across the axial direction of the boss portion 502B.

Additionally, in this embodiment, as one example, the minimum reference contact pressure Fa was derived to be 0.72 $N/mm^2$ in the state where the temperature setting of the surrounding environment was 32.5° C. for the drive chassis 40 made of the ABS resin containing polycarbonate. Accordingly, the high durability of the drive unit 4 is ensured when, with the minimum reference contact pressure Fa set to be equal to or less than 0.72 $N/mm^2$, the form of the rotation shaft 501 or the rotation gear 502 is set such that the contact pressure Fb satisfies the relationship: $Fb\ (=F/D \times L) < Fa$.

Furthermore, at the first step, with the load torque of the test rotated component elevated in the high temperature environment where the surrounding environment is equal to or more than 30° C., the minimum reference contact pressure Fa is derived. Accordingly, since the reference contact pressure derivation test is performed at the stress condition where the test rotation shaft 601 is damaged easily, the predetermined safety factor is considered and the drive unit 4 with higher durability can be designed.

While the design method of the drive unit 4 according to the embodiment of the disclosure, the drive unit 4 designed by the design method, and the image forming apparatus 1 including the drive unit 4 have been described above, the disclosure is not limited to these. While in the above-described embodiment an aspect where the minimum reference contact pressure Fa is derived by the reference contact pressure derivation test at the first step, the aspect for deriving the minimum reference contact pressure Fa corresponding to resin material to be used by a simulation based on the mechanics of materials and the theory of structures may also be effective.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method of designing a drive unit, the drive unit including a sheet metal frame having a plurality of bearing holes;

a housing mounted on the sheet metal frame, the housing being made of a predetermined resin material, the housing provided with a plurality of shaft portions projecting toward the sheet metal frame, each of the plurality of shaft portions having a distal-end portion pivotally supported in the bearing holes; and a plurality of gears rotatably mounted respectively on the plurality of shaft portions, wherein the drive unit is linked to a preestablished drive source and transmits, via a drive transmission path constituted by the plurality of the gears, rotational driving power of the drive source to rotated components each having a predetermined load torque;

wherein the design method comprises:

deriving a minimum reference contact pressure Fa being a contact pressure acting on the plurality of shaft portions made of the resin material, and being the minimum contact pressure that leads to damage in any shaft portion among the plurality of the shaft portions; and designing the shaft portions or the gears to be of form such that the plurality of shaft portions and the plurality of gears satisfy the relationship $F/D \times L < Fa$, given that, with the plurality of shaft portions and the plurality of gears linked to the drive source and the rotated components, the load acting on a single of the shaft portions among the plurality of shaft portions is F (N), the diameter of the single of the shaft portions is D (mm), and the length of axial contact between the single of the shaft portions and the gear mounted thereon is L (mm).

2. The drive-unit design method according to claim 1, wherein the deriving includes:

with a plurality of test gears mounted onto a test housing provided with a plurality of test shaft portions disposed with their distal-end portions projecting toward the sheet metal frame and each pivotally supported in the shaft bearing holes, the test housing being constituted of the same resin material as that of the housing, in a situation in which the drive source is driven and load torque on test rotated components linked to the drive transmission path is elevated, when any of the test shaft portions is damaged, deriving the minimum reference contact pressure Fa as the contact pressure acting on the circumferential surface of the damaged test shaft portion.

3. The design method of the drive unit according to claim 2, wherein the deriving includes:

deriving the minimum reference contact pressure Fa with the load torque on the test rotated components being elevated in a high-temperature environment in which the surrounding environs are at 30° C. or greater.

4. The design method of the drive unit according to claim 1, wherein: at least one of the gears among the plurality of the gears includes a gear main portion including an inner peripheral portion pivotally supported on the shaft portion and an outer peripheral portion having gear teeth; and a boss portion disposed axially projecting from the gear main portion, the boss portion being sequential with the inner peripheral portion and pivotally supported on the shaft portion together with the gear main portion; wherein the designing includes designing the projecting length of the boss portion as the gear form satisfying the relationship of $F/D \times L < Fa$.

5. The design method of the drive unit according to claim 1, wherein:

the resin material is an ABS resin containing a polycarbonate; and the minimum reference contact pressure Fa is equal to or less than 0.72 $N/mm^2$.

6. A drive unit designed by the design method according to claim 1.

7. An image forming apparatus comprising:

the drive unit according to claim 6;

the rotated components to which the rotational driving power is transmitted via the drive transmission path; and an image forming unit configured to form an image on a sheet.

* * * * *